US005738231A

United States Patent [19]

Montgomery

[11] Patent Number: 5,738,231

[45] Date of Patent: Apr. 14, 1998

[54] TAMPER INDICATING THREADED CLOSURE-CONTAINER PACKAGE

[75] Inventor: Gary V. Montgomery, Evansville, Id.

[73] Assignee: Rexam Closures, Inc., Evansville, Ind.

[21] Appl. No.: 635,371

[22] Filed: Apr. 19, 1996

[51] Int. Cl.[6] ..... B65D 1/02

[52] U.S. Cl. ..... 215/44; 215/230; 215/344

[58] Field of Search ..... 215/44, 45, 230, 215/252, 258, 329, 341, 344, 349, DIG. 1, 901; 220/288, 289, 290; 206/459.1, 459.5

[56] References Cited

U.S. PATENT DOCUMENTS 4,325,487 4/1982 Libit .
4,823,967 4/1989 Thompson .
5,105,961 4/1992 Noren et al. .
5,275,287 1/1994 Thompson .
5,320,236 6/1994 Gregory .
5,379,910 1/1995 Montgomery .
5,450,973 9/1995 Ellis et al. .
5,456,375 10/1995 May .

*Primary Examiner*—Allan N. Shoap
*Assistant Examiner*—Nathan Newhouse
*Attorney, Agent, or Firm*—Gifford, Krass, Groh, Sprinkle, Patmore, Anderson & Citkowski, P.C.

[57] ABSTRACT

A threaded tamper indicating closure-container package provides an indication of initial opening by how far the closure threads onto the container neck. In the original package condition the bottom of the closure skirt is adjacent a shoulder on the container. After the package has been initially opened and the closure reapplied, the bottom of the closure skirt is noticeably above the container shoulder. A word message such as "opened" can also be exposed on the container neck between the shoulder and the bottom of the closure skirt when the closure is reapplied.

22 Claims, 5 Drawing Sheets

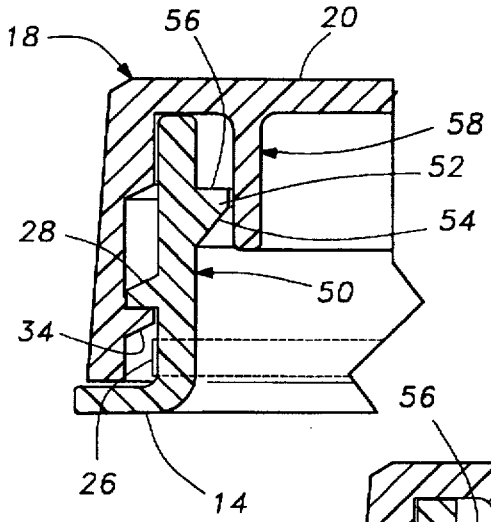
Fig-6
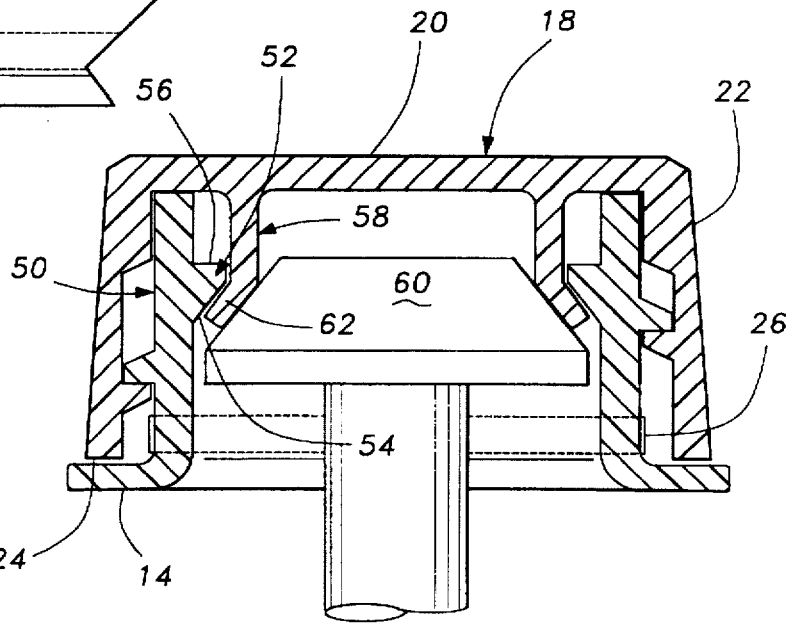
Fig-7
Fig-8
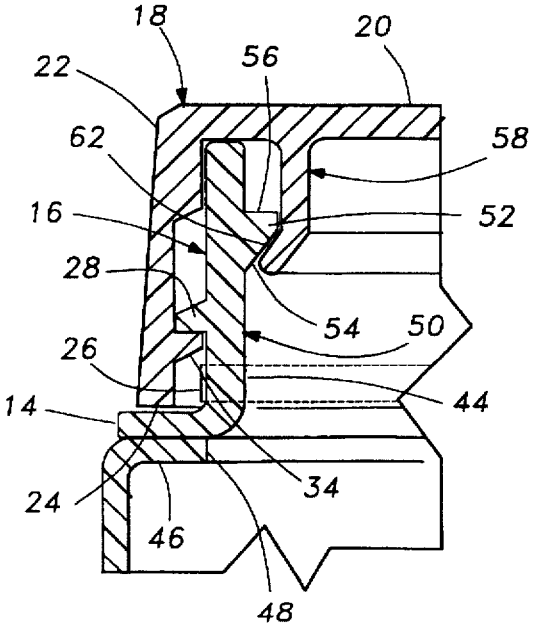
Fig-9
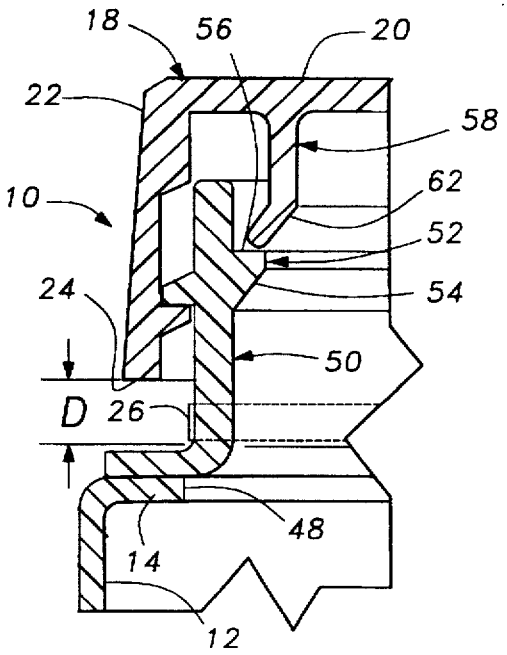

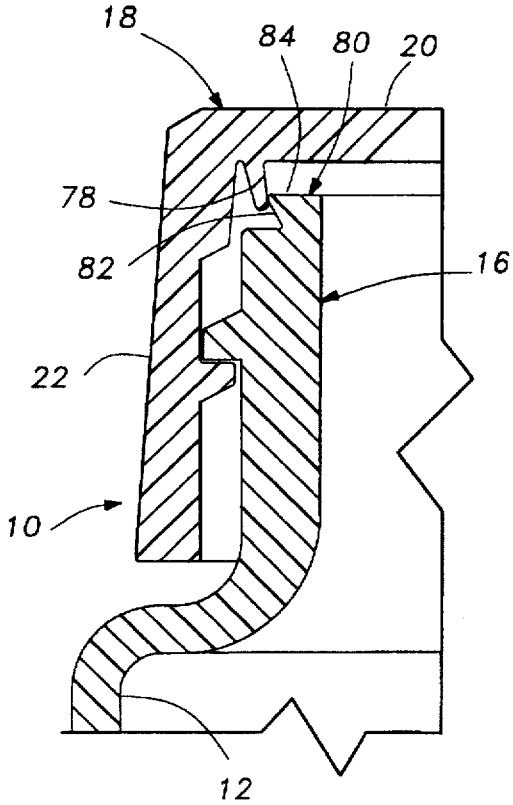
Fig-14
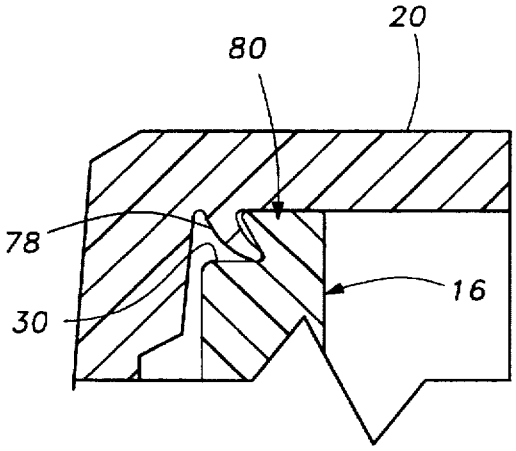
Fig-15
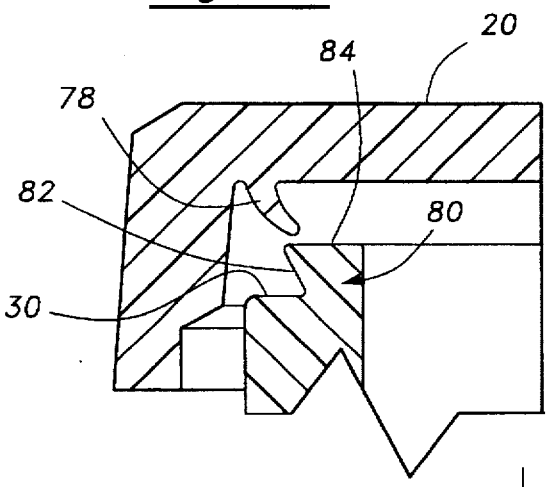
Fig-16
Fig-17
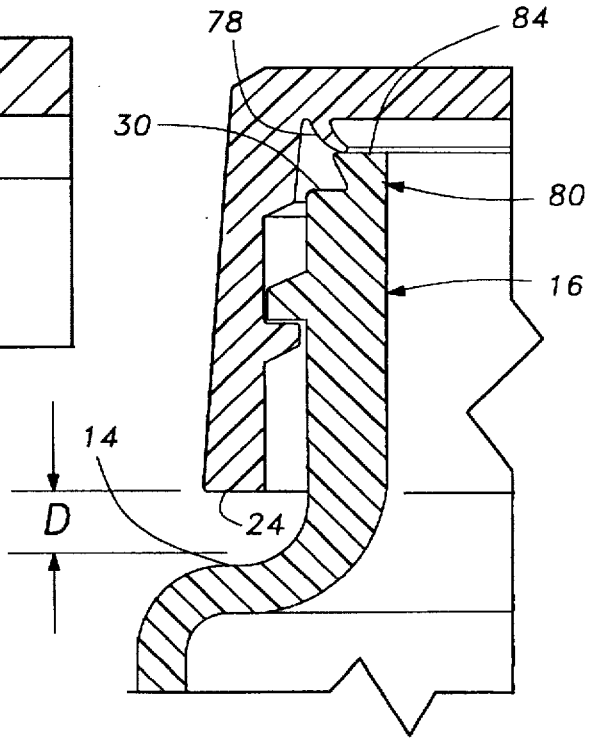

TAMPER INDICATING THREADED CLOSURE-CONTAINER PACKAGE

BACKGROUND OF THE INVENTION

1. Field of the Invention

This invention relates to threaded closure-container packages, and, more particularly, this invention relates to tamper indicating closure-container packages.

2. State of the Art

Tamper indicating packages are provided with some element that changes its appearance when any attempt is made to open the package once the container is initially filled and the closure is applied.

One of the most popular tamper indicating packages employs a band that is attached to the bottom of the closure cap skirt by a frangible connection. The band and the container neck have cooperating stops, usually in the form of cooperating ratchet teeth or circumferential beads which slide over each other as the closure is initially applied to the container but which engage each other when unthreading torque is applied to the cap to prevent axial movement of the band. In one version, the band is fashioned as a tear strip which can be removed by pulling a tab on the tear strip which breaks the frangible connection. Observation that the tear strip has been removed indicates tampering or initial opening. In another version, the continuing rotation of the cap will cause the fracture of the frangible connection leaving the tamper indicating band on the container neck as evidence of initial opening.

There is a large variety of tamper indicating band closures available, designed with various features to overcome difficulties that are experienced with this type of closure. The frangible connection, usually in the form of breakable webs, have to be strong enough to resist breakage during threading on of the closure, but must break without excessive torque being required during the unthreading process. Sealing considerations and other aspects have prolificated designs of this type of closure.

There is a need to provide a tamper indicating closure which does not require a frangible connection which must be broken to provide the tamper indication.

SUMMARY OF THE INVENTION

The present invention provides a closure-container package with a tamper indicating feature that does not require a frangible connection at the bottom of the closure cap skirt. Tampering or initial opening is indicated by a change in height between the bottom of the cap skirt and a container shoulder. When the closure is initially applied to the container in the packaging process, the bottom of the cap skirt abuts or is closely adjacent to a container shoulder. When the closure is reapplied after initial opening, the bottom of the cap skirt will be noticeably above the container shoulder.

The closure has a top and a cylindrical skirt depending from the periphery of the top. The skirt has an internal thread complementary to the container neck thread. Either the closure or the container has an axially extending annular flange and the other of the closure or container has first and second abutment surfaces which are contacted by the annular flange. When the closure is initially threaded onto the container neck, the annular flange is displaced radially into contact with the first abutment surface, and the bottom of the closure skirt assumes a first position adjacent to the container shoulder. The annular flange receives a permanent set by its flexure into a new position in contact with the first abutment surface so that when the closure is unthreaded from the container neck and reapplied to the container neck, the annular flange does not return to its original as molded condition so that it contacts the second abutment surface. The flange is relatively stiff in an axial direction and limits the movement of the closure axially in a closing direction. As a result the bottom of the closure skirt will assume a second position vertically above the first position to indicate that the closure has been previously opened.

In a first embodiment of the invention, the annular flange extends upwardly from a lip of the container neck. The first abutment surface is on an inner skirt of the closure as a converging conical surface which extends downwardly from the cap top. The second abutment surface is on a projection extending inwardly from the closure skirt above the closure thread. When the closure is initially threaded onto the container neck, the annular flange is flexed outwardly by contact with the converging conical first abutment surface. The flange retains the outward deflection or takes a permanent set so that when the closure is unthreaded and reapplied to the container neck, the annular flange is directed toward and will contact the second abutment projection surface to limit the threading-on of the closure so that the bottom of the cap skirt is spaced above the container shoulder. The annular flange seals against the first abutment surface when the closure is initially threaded onto the container neck, and it seals against the second abutment surface when the closure is reapplied to the container neck. The inner skirt can diverge outwardly from the conical surface to form a rotary seal with an internal surface of the container neck.

In other embodiments of the invention, the annular flange extends downwardly from the closure, and the first and second abutment surfaces extend from the container. In some of these embodiments, the annular flange extends downwardly from the closure top. If the container is in the form of a can or a carton such as a milk or juice containing carton, the pouring neck can be a molded plastic when the fitment is applied to the container, it furnishes the container shoulder and the container neck. An inwardly directed projection on the container neck also provides the first and second abutment surfaces for contact with a diverging end portion of the annular flange extending downwardly from the closure top.

In another embodiment, the annular flange can extend downwardly from the closure top to contact first and second abutment surfaces on a projection extending upwardly from the lip of a container neck. The annular flange can converge to contact an outer surface of the projection as the first abutment surface and to contact a top surface of the projection as the second abutment surface. The projection can have a conical diverging outer surface. The closure can also have a diverging inner skirt extending downwardly from the closure top to provide a rotary seal with an internal surface of the container neck.

In still another embodiment, the internal closure thread can have a first heavy deep thread portion adjacent the closure top for initialing threading the closure onto the container neck, flexing the annular flange into contact with the outer surface of the projection as the first abutment surface. The thread can have a second shallower thread portion extending from the first thread portion away from the closure top which allows reapplication of the closure onto the container neck with the annular flange in contact with the top surface of the projection as the second abutment surface.

In another embodiment, the annular flange can extend downwardly from the cap skirt with the container shoulder constituting the first abutment surface and a ledge extending outwardly from the container neck between the shoulder and the external neck thread providing the second abutment surface.

DRAWING

The advantages of the present invention will be more apparent from the following detailed description when considered in connection with the accompanying drawing wherein:

FIG. 6 is a partial cross-section of a second embodiment of the invention showing the closure as it is applied to a fitment;

FIG. 7 is a cross-section of a closure of FIG. 6 showing flaring of an annular flange of the cap after the cap has been threaded onto a fitment;

FIG. 8 is a partial cross-section of the invention of FIG. 6 showing the fitment attached to a container with the closure in its initial as packaged position;

FIG. 9 is a partial cross-section similar to FIG. 8 showing the closure as it has been reapplied after initial opening;

FIG. 14 is a partial cross-section of a fourth embodiment of the invention as the closure is being initially applied to the container neck;

FIG. 15 is a partial cross-section of the package of FIG. 14 showing the closure as it is initially applied to the container neck;

FIG. 16 is a partial cross-section showing the closure of FIG. 14 being reapplied to the container neck after initial opening;

FIG. 17 is a partial cross-section similar to FIG. 14 showing the closure of FIG. 14 as it has been reapplied to the container neck after initial opening;

DETAILED DESCRIPTION OF THE PREFERRED EMBODIMENTS

Figure 1:
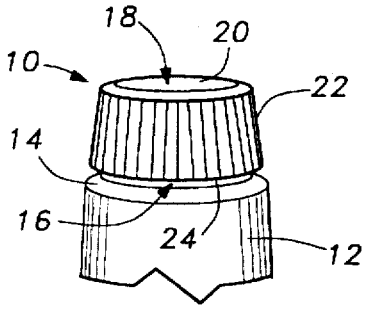
FIG. 1 is a perspective view of a threaded closure according to the invention as it is initially applied to a container neck.
Figure 2:
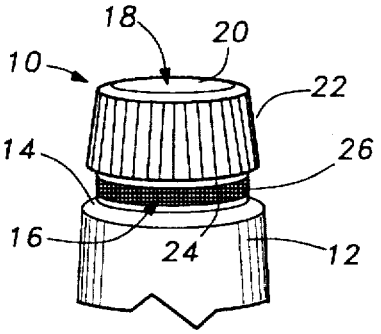
FIG. 2 is a perspective view of the threaded closure of FIG. 1 as the closure is reapplied to the container neck after initial opening.
Figure 20:
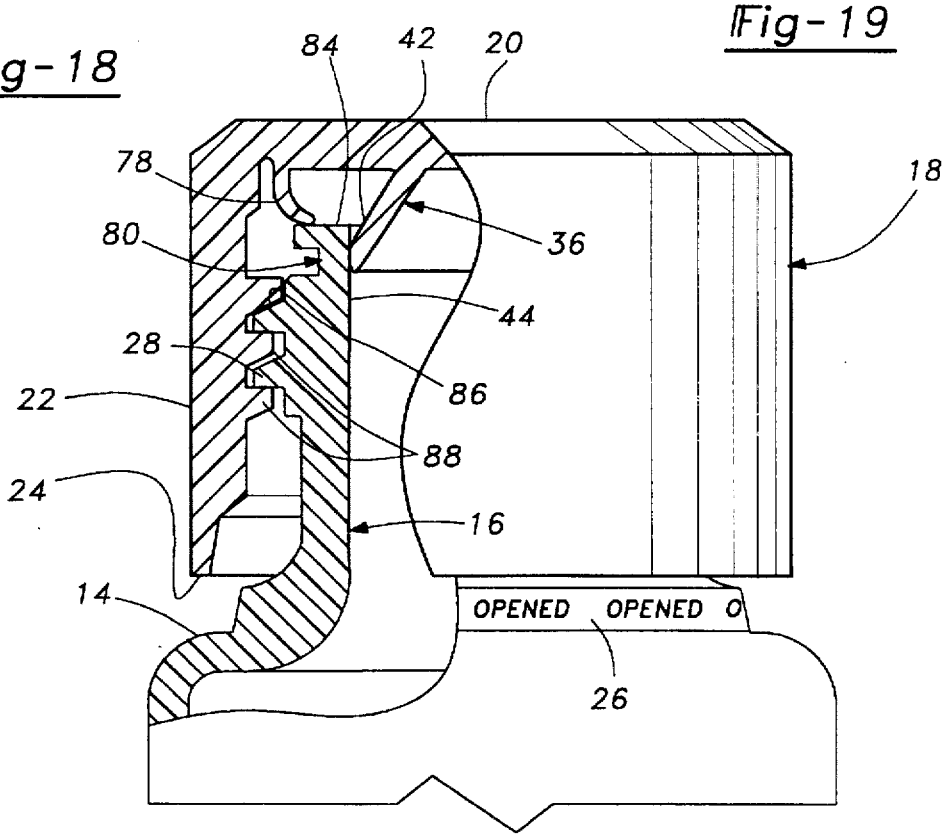
FIG. 20 is a partial cross-section of the closure-container package of FIG. 18 as the closure has been reapplied to the container neck after initial opening.

Referring to FIGS. 1 and 2, the tamper indicating closure-container package 10 according to the present invention includes a container 12 having a shoulder 14 and a threaded neck 16 which is closed by a threaded closure 18. The closure 18 has the appearance of a standard threaded cap with a top 20 and an annular skirt 22 depending from the periphery of the top. When the closure cap is initially threaded on the container neck in the packaging process, the bottom 24 of the cap skirt will abut or be closely adjacent to the container shoulder 14 as seen in FIG. 1. When the closure is initially removed and reapplied to the container neck, the bottom 24 of the cap skirt will be above the container shoulder by a very obvious distance indicating to the user that the package has been previously opened. An indicia 26 can be exposed on the container neck emphasizing the height change and tamper indication. The indicia 26 can be a word message such as simply the word "opened" inscribed around the neck as shown in FIG. 20. Likewise the indicia can be just a color change or the worded message can be in a different color.

Figure 3:
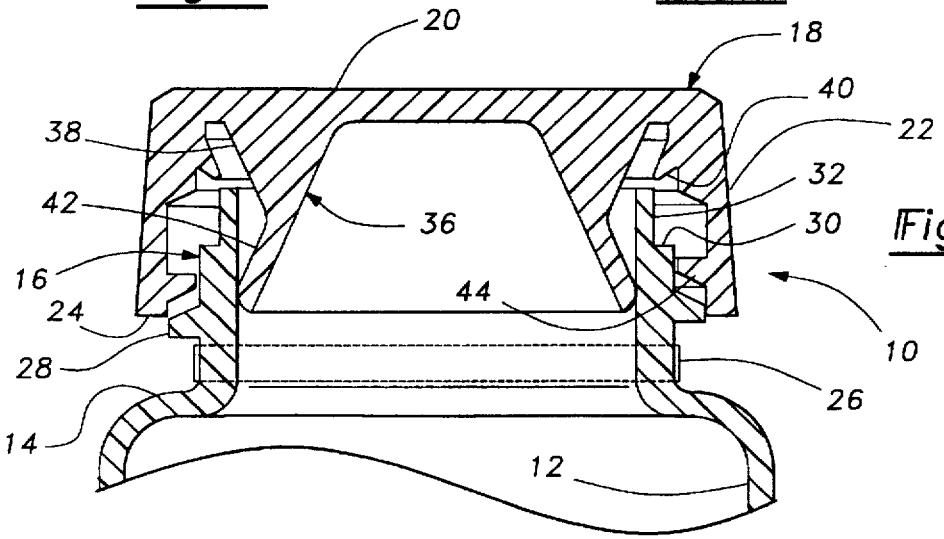
FIG. 3 is an elevational cross-section of a closure/container package as the closure is being initially applied to the container neck.
Figure 4:
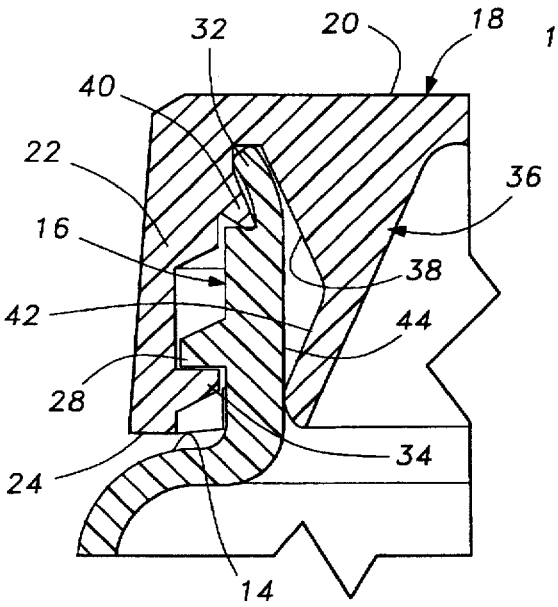
FIG. 4 is a partial cross-section of the package of FIG. 3 with the closure fully threaded onto the container neck as it is initially packaged.
Figure 5:
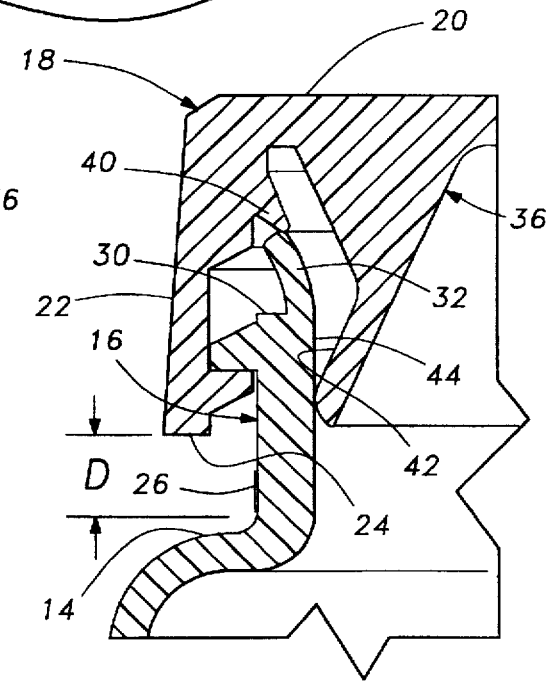
FIG. 5 is a partial cross-section of the package of FIG. 3 as the closure is reapplied to the container neck after initial opening.

In the embodiment shown in FIGS. 3–5, the container neck 16 has an external thread 28 and a lip 30. An annular flange 32 extends upward from the container neck lip 30. The closure or cap 18 has an internal thread 34 on the annular cap skirt 22. An inner skirt 36 depends downwardly from the cap top 20 to provide a converging conical first abutment surface 38. A second abutment surface is provided by a projection 40 extending inwardly from the closure skirt 22. The inner skirt 36 extends below the diverging conical first abutment surface 38 into a diverging end portion 42 to form a continuous rotary seal with the internal surface 44 of the container neck 16.

As the closure 18 is initially threaded onto the container neck 16, the upwardly extending annular flange 32 on the container neck contacts the diverging conical first abutment surface 38 causing the annular flange 32 to deflect and outwardly with a permanent set as it seals against that surface. At the same time, closure skirt projection or second abutment surface 40 contacts and seals against the container neck lip 30. A primary rotary seal will also exist between the diverging plug portion 42 of the inner skirt 36 and the internal neck surface 44. At this initial capping position, the bottom 24 of the cap skirt 22 will abut against or be adjacent to the container shoulder 14.

When the closure 18 is removed and reapplied, the now diverging annular neck flange 32 will contact and seal against the lower portion of projection 40 with the bottom 24 of the cap skirt 22 being a distance D above its initial sealing position with the word indicia 26, "opened" clearly visible as shown in FIG. 5.

In the embodiment of FIGS. 6–9, the container 12 is in the form of a carton or can having a flat top 46 with an access opening 48, as seen in FIGS. 8 and 9. A molded plastic fitment 50 having a shoulder 14 and a threaded neck 16 has its shoulder 14 bonded to the container top 46 with the container access opening 48 in line with the internal neck surface 44. The fitment 50 has an external neck thread 28 for coaction with the internal cap neck thread 34, and it has an inwardly extending projection 52 on its neck 16. The projection 52 has a bottom first abutment surface 54 and a top second abutment surface 56. The closure 18 has an inner skirt 58 which extends downwardly from the cap top 20. The closure 18 is threaded onto the fitment 50 with the inner skirt 58 passing inside of the fitment projection 52 before the fitment is bonded to the container as shown in FIG. 6. A flaring tool 60 is introduced into the assembled fitment and closure to form an outwardly diverging annular flange 62 at the end of the inner skirt 58 as seen in FIG. 7. The outwardly diverging annular flange 62 contacts and seals against the first abutment surface 54, and the fitment is bonded to the container as shown in FIG. 8 with the bottom 24 of the annular closure skirt 22 abutting or being adjacent to the shoulder 14. When the closure 18 is initially removed and reapplied, the lower edge of the downwardly projecting diverging annular flange 62 will contact and seal against the second abutment surface 56 on the upper side of projection 52, and the bottom 24 of the closure skirt 22 will be at a distance D above its initial sealing position, also exposing the "opened" indicia 26 on the container neck as shown in FIG. 9.

Figure 10:
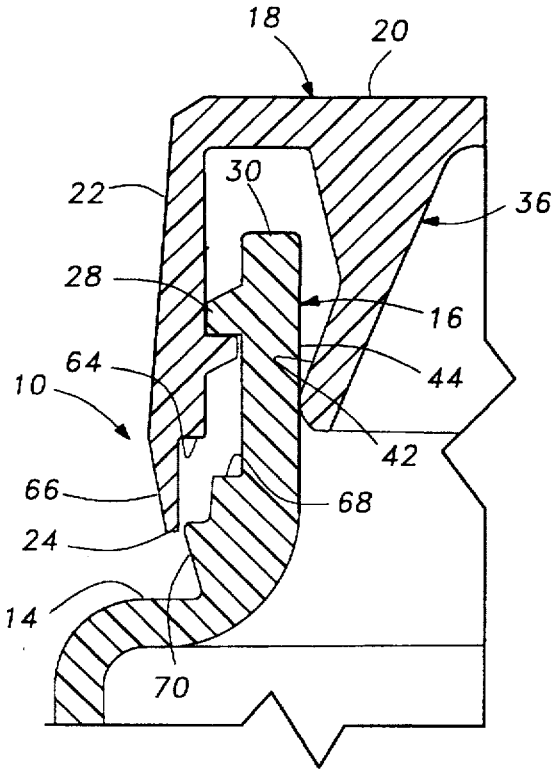
FIG. 10 is a partial cross-section of a third embodiment of the closure-container package of the invention as the closure is being initially applied to the container neck.
Figure 11:
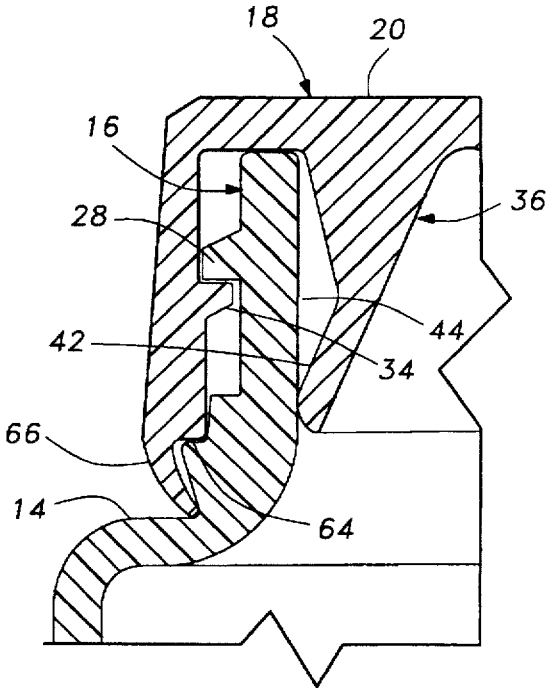
FIG. 11 is a partial cross-section similar to FIG. 10 with the closure fully applied to the container neck in the initial packaging.
Figure 12:
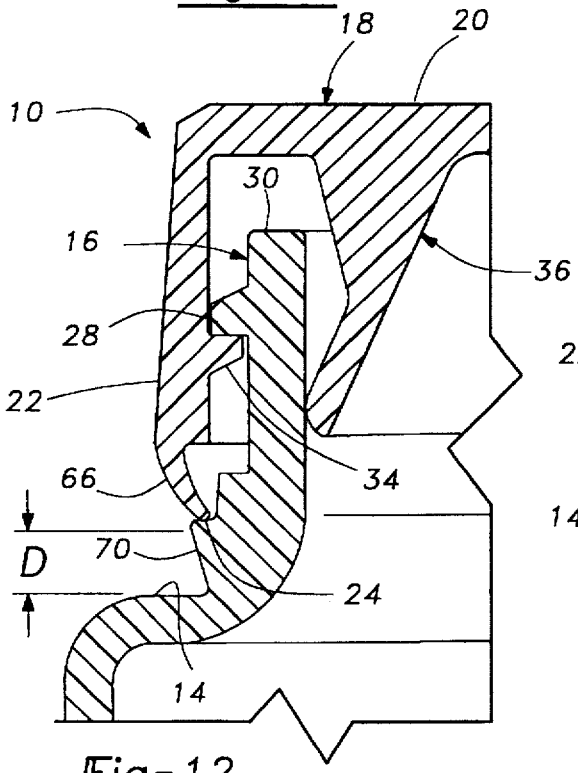
FIG. 12 is a cross-section similar to FIG. 11 showing the closure as it has been reapplied to the container neck after initial opening.
Figure 13:
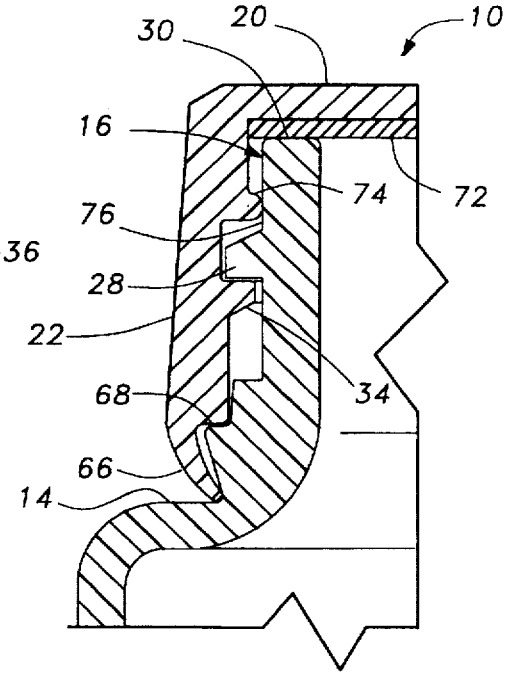
FIG. 13 is a partial cross-section similar to FIG. 11 showing a variation of the third embodiment of FIG. 10 with the closure in its initial as packaged position.

In the embodiments of FIGS. 10–13, the lower portion of the closure skirt 22 is undercut at 64 to form a thin section constituting an annular flange 66. The container shoulder 14 constitutes the first abutment surface, and the container neck 16 has an outwardly extending ledge 68 between the shoulder 14 and the external thread 28 which constitutes the second abutment surface. When the closure 18 is initially threaded onto the container neck, as seen in FIGS. 10, 11 and 13, the annular flange 66 contacts and forms a secondary seal with the container shoulder 14 permanently skewing or bowing the annular flange 14 inwardly. The undercut 64 can also contact the ledge 68, and the neck wall below the ledge 68 and above the shoulder 14 can have an inward relief at 70, as shown in FIG. 10, to control the inward set given to the annular flange 66.

The primary seal in the embodiment of FIGS. 10–12 is the same continuous rotary seal as that used in the embodiment of FIGS. 3–5 between the diverging plug portion 42 of the inner skirt 36 and the internal neck surface 44 of the container neck 16. In the optional construction of FIG. 13, the primary seal is furnished by the insert or gasket 72 acting between the container neck lip 30 and the closure top 20. An inwardly directed bead 74 on the closure skirt 22 above the internal closure thread and contacting the outside cylindrical surface 76 of the container neck 16 provides a continuous rotary secondary seal.

As the closure 18 of FIGS. 10–13 is initially threaded onto the container neck 16, as seen in FIGS. 10 and 11, the annular flange 66 at the bottom of the cap skirt 22 contacts and forms a secondary seal with the container shoulder 14 causing the flange to bow inwardly with a permanent set. In this initial capping position, the bottom 24 of the cap skirt obviously abuts against the shoulder 14.

When the closure 18 is removed and reapplied, the now converging annular flange portion 66 of the cap skirt 22 will contact and form a secondary seal with the container neck ledge 68 with the bottom 24 of the cap skirt 22 being a distance D above its initial sealing position as seen in FIG. 12 to indicate prior opening.

Figure 18:
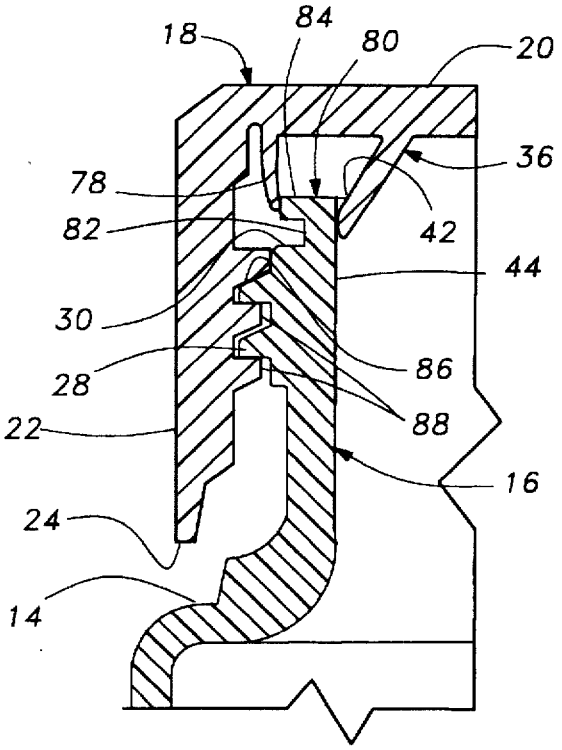
FIG. 18 is a partial cross-section of a fifth embodiment of the invention showing the closure as it is being initially applied to the container neck.
Figure 19:
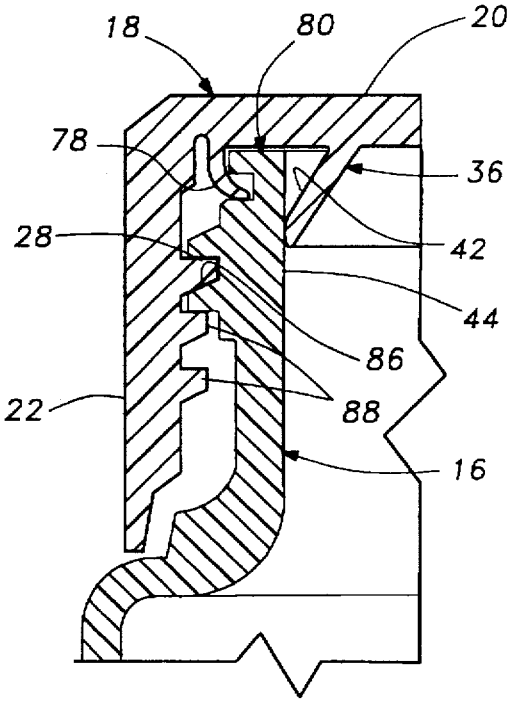
FIG. 19 is a partial cross-section similar to FIG. 18 showing the closure as it has been fully applied to the container neck in the initial packaging.

In the embodiments of FIGS. 14–17 and FIGS. 18–20, an annular flange 78 depends downwardly from the cap top 20 preferably at a slight inward angle, and a projection 80 extends upwardly from the container neck lip 30. The projection 80 has an outer relief surface 82, which in the embodiment of FIGS. 14–17 is shown as a conical surface diverging outwardly and in the embodiment of FIGS. 18–20 is shown as an undercut surface, which acts at least as a portion of a first abutment surface. The top surface 84 of the projection 80 acts as a second abutment surface. In both embodiments, as seen in FIGS. 14 and 18, as the closure is being threaded onto the container neck for the first time, the annular flange 78 will clear the top surface 84 of the projection 80 and will contact the container neck lip 30, moving toward the outer projection surface 82 as a guide as the closure is tightened as seen in FIGS. 15 and 19. The lip 30 and the outer projection surface 82 act as the first abutment surface, giving the annular flange 78 a further inward set. When the closure is removed and reapplied, the annular flange 78 will be pointed toward the top, second abutment surface 84 as best seen in FIG. 16 and will tighten in contact with the top surface as seen in FIGS. 17 and 20. The bottom of the cap skirt 24 will be spaced above its original tightened position a distance D as shown in FIG. 17 which can expose a worded "opened" message 26 on the container neck as seen in FIG. 20.

In the embodiments of FIGS. 14–17, the primary seal is between the annular flange 78 of the closure 18 and the lip 30 and first abutment surface 82 when the closure is initially applied to the container neck. An additional seal may be used such as a fin seal extending downwardly from the cap top to engage the top surface 84 of the projection 80. When the closure has been removed and reapplied, the primary seal will be between the annular flange 78 and the second abutment surface, top surface 84 of the projection 80.

In the embodiment of FIGS. 18–20, the primary seal is a continuous rotary seal between the diverging end portion 42 of inner skirt 36 and the inner neck surface 44 in a manner similar to the seal supplied in the embodiments of FIGS. 3–5 and 10–12. It will be apparent that while the rotary seal provides a very good primary seal, other seals such as a fin seal depending from the cap top to contact the top of the projection can be used.

In this embodiment of FIGS. 18–20, the external container neck thread 28 is a full continuous thread, but the closure thread is only a full, heavy or deep thread in its portion 86 closest to the cap top 20 and it makes a transition into a shallower thread portion 88 towards the bottom of the cap skirt. When the closure 18 is initially applied to the container neck 16, the container neck thread 28 will fully engage the full thread portion 86 of the cap. However, when the package has been opened and the closure 18 is reapplied to the container neck 16, the engagement of the annular flange 78 with the second abutment surface 80 will prevent the closure from threading on past the shallow thread portion 88, and any attempt to further tighten the closure will result in merely stripping the thread.

I claim:

1. A threaded tamper indicating closure-container package comprising:

a container having a shoulder and a neck extending upward from said shoulder, said neck having an external thread;

a closure having a top and a cylindrical skirt depending from the periphery of said top, said skirt having an internal thread complementary to said container neck thread;

one of said closure and container having an axially extending annular flange and the other of said closure and container having first and second abutment surfaces;

said closure being initially threaded onto said container neck to pass said second abutment surface and engage said first abutment surface to deflect said annular flange radially to a new configuration at which the bottom of said closure skirt assumes a first position adjacent said container shoulder and said annular flange takes a permanent set to assume said new configuration upon removal of said closure from said container; and said closure being removable from said container neck and reapplied to said container neck during which time, said annular flange remains substantially in said new configuration and engages said second abutment surface to limit closing movement so that the bottom of said closure skirt will assume a second position vertically above said first position to indicate that said closure has been previously opened.

2. The closure-container package according to claim 1 wherein said container neck has a word indicia above said shoulder indicating the closure has been opened, said indicia being visible when said closure is reapplied and the bottom of said closure skirt is in its second position.

3. The closure-container package according to claim 1 wherein said annular flange extends upwardly from a lip of said container neck; said first abutment surface is on an inner skirt of said closure as a converging conical surface extending downwardly from said closure top; and said second abutment surface is on a projection extending inwardly from said closure skirt above said closure thread.

4. The closure-container package according to claim 3 wherein said annular flange seals against said first abutment surface when said closure is initially threaded onto said container neck.

5. The closure-container package according to claim 3 wherein said projection seals against said container neck lip when said closure is initially threaded onto said container neck.

6. The closure-container package according to claim 3 wherein said inner skirt diverges outwardly from said conical surface to form a rotary seal with an internal surface of said container neck.

7. The closure-container package according to claim 3 wherein said annular flange seals against said second abutment surface when said closure is reapplied to said container neck.

8. The closure-container package according to claim 1 wherein said annular flange extends downwardly from said closure, and said first and second abutment surfaces project from said container neck.

9. The closure-container package according to claim 8 wherein said annular flange extends downwardly from said closure top; a fitment is applied to said container to provide said container shoulder and said container neck, and an inwardly directed projection on said container neck provides said first and second abutment surfaces.

10. The closure-container package according to claim 9 wherein an axially extending portion of said inwardly directed projection provides at least a portion of said first abutment surface.

11. The closure-container package according to claim 9 wherein an end portion of said annular flange diverges outwardly and a bottom portion of said inwardly directed projection provides at least a portion of said first abutment surface in contact with an upper surface of the diverging end portion of said annular flange.

12. The closure-container package according to claim 10 wherein a top portion of said inwardly directed projection provides said second abutment surface in contact with the diverging end portion of said annular flange.

13. The closure-container package according to claim 8 wherein a lower portion of said closure skirt constitutes said annular flange; said shoulder constitutes said first abutment surface; and a ledge extending outwardly from said container neck between said shoulder and said external thread provides said second abutment surface.

14. The closure-container package according to claim 13 wherein a liner provides a seal between said closure top and a lip of said container neck when said closure is initially applied to said container neck.

15. The closure-container package according to claim 13 wherein an inwardly projecting bead on said closure skirt above said internal thread provides a rotary seal in contact with an external surface of said neck.

16. The closure-container package according to claim 13 wherein a diverging inner skirt extending downwardly from said closure top provides a rotary seal with an internal surface of said container neck.

17. The closure-container package according to claim 8 wherein said annular flange extends downwardly from said closure top; said first abutment surface includes an outer portion of a projection extending upwardly from a lip of said container neck; and said second abutment surface is an upper portion of said projection.

18. The closure-container package according to claim 17 wherein said annular flange converges inwardly.

19. The closure-container package according to claim 17 wherein said projection has a conical surface diverging outwardly which forms a portion of said first abutment surface.

20. The closure-container package according to claim 17 wherein a diverging inner skirt extending downwardly from said closure top provides a rotary seal with an internal surface of said container neck.

21. The closure-container package according to claim 17 wherein said internal closure skirt thread has a first heavy deep thread portion adjacent said closure top for initial threading said closure onto said container neck, flexing said annular flange into contact with said first abutment surface and a second shallower thread portion extending from said first thread portion away from said closure top which allows reapplication of said closure onto said container neck with said annular flange in contact with said second abutment surface.

22. The closure-container package according to claim 20 wherein when said closure is reapplied to said container neck, the second shallower thread portion allows the closure to be threaded-on until said annular flange contacts said second abutment surface, but further threading-on effort results in stripping said second shallower thread portion.

* * * * *